US008689363B2

(12) United States Patent
Kishihara et al.

(10) Patent No.: US 8,689,363 B2
(45) Date of Patent: Apr. 8, 2014

(54) GLOVE AND METHOD FOR PRODUCING THE SAME

(75) Inventors: Hidetoshi Kishihara, Hyogo (JP); Yasuyuki Ii, Hyogo (JP)

(73) Assignee: Showa Glove Co., Himeji-Shi (JP)

( * ) Notice: Subject to any disclaimer, the term of this patent is extended or adjusted under 35 U.S.C. 154(b) by 181 days.

(21) Appl. No.: 13/159,551

(22) Filed: Jun. 14, 2011

(65) Prior Publication Data

US 2012/0000005 A1 Jan. 5, 2012

(30) Foreign Application Priority Data

Jul. 2, 2010 (JP) ..... 2010-152493
May 25, 2011 (JP) ..... 2011-116610

(51) Int. Cl.
*A41D 19/00* (2006.01)

(52) U.S. Cl.
USPC ..... 2/161.8

(58) Field of Classification Search
USPC ..... 2/159, 161.1, 161.3, 161.6, 161.8, 167, 2/169
See application file for complete search history.

(56) References Cited

U.S. PATENT DOCUMENTS 2,393,298 A * 1/1946 De Laney et al. ..... 2/168
4,329,312 A * 5/1982 Ganz ..... 264/306
4,497,072 A * 2/1985 Watanabe ..... 2/169
7,310,826 B2 * 12/2007 Kishihara ..... 2/161.6
7,487,553 B2 * 2/2009 Price ..... 2/161.1
7,771,644 B2 * 8/2010 Flather et al. ..... 264/307
8,119,200 B2 * 2/2012 Kassam et al. ..... 427/337
8,387,167 B2 * 3/2013 Matsunobu et al. ..... 2/161.1

FOREIGN PATENT DOCUMENTS

JP 7-278923 A 10/1995
JP 11-290497 A 10/1999
JP 4242338 B2 1/2009

* cited by examiner

*Primary Examiner* — Tejash Patel

(74) *Attorney, Agent, or Firm* — Kratz, Quintos & Ahnson, LLP

(57) ABSTRACT

A glove with a coating layer of rubber containing air bubbles formed at least on the surface of a back portion of a glove base material made of fibers is provided, wherein the moisture permeability of the coating layer of the back portion ranges from 1000 to 9000 g/m$^2$·24 hrs in terms of a measured value according to JIS L 1099 A-1 method (calcium chloride method) and the wear loss of the coating layer of the back portion is 40 mg or less in terms of a value measured after 100 revolutions by use of a tester, Nu-Martindale Abrasion and Peeling Tester, specified by EN ISO 12947-1, according to the European Standard EN 388; 2003. The glove of the present invention is excellent in moisture permeability and abrasion resistance of a back portion.

10 Claims, 4 Drawing Sheets

(a)

(b)

(a)

(b)

GLOVE AND METHOD FOR PRODUCING THE SAME

BACKGROUND OF THE INVENTION

1. Field of the Invention

The present invention relates to a glove having excellent moisture permeability and abrasion resistance of a back portion, and more specifically, to a glove which, by forming a coating layer having excellent moisture permeability and abrasion resistance on a back portion which tends to be damaged due to rubbing or scratching, does not bring about heat trapped and a steamy condition in a glove to provide an excellent feel when wearing and can further protect the back portion from breakages due to rubbing or scratching or from perforations or damages due to sparks generated in a metal cutting work, and a method of producing the same.

2. Description of the Related Art

Hitherto, as the gloves of this kind, a glove in which a coating layer is provided by sticking or sewing a synthetic leather to a palm portion of a glove made of fibers, and a glove, in which a palm portion is covered with resin or rubber and a back portion is not provided with these coating layers to secure air permeability of a base material made of fibers, are used.

For example, in a glove for sporting in which a palm portion is composed of a natural leather or a synthetic leather and the whole back of the hand including finger bags is composed of a fabric, a glove for sporting, in which the whole back of the hand including finger bags in a glove main body is configured so as to be a two-layered structure in which a chemical fiber fabric is disposed on an inner side and a cotton fabric is disposed on an outer side, is proposed (for example, JP-A-11-290497).

Further, a slip resistant glove in which a foam layer composed of a thermoplastic resin or rubber is formed on the glove base material made of fibers and the surface of the foam layer has a projection and depression shape, in which the foam layer is mechanically foamed and hot pressed in a semi-crosslinked or gelled state to be provided with projections and depressions on the surface, and a depression portion of the foam layer is compressed in such a way that an air bubble content is 10 to 90% by volume with respect to that of a projection portion, and many openings being the impressions of air bubbles are formed at the surface of the projection portion, is proposed (for example, Japanese Patent Publication No. 4242338).

Furthermore, a working glove is proposed which is characterized in that a slip resistant coating is formed by coating the surface of a glove main body formed by sewing leather as a material with a synthetic rubber and the synthetic rubber is a copolymer of butadiene and styrene or a copolymer of butadiene and acrylonitrile, which is excellent in oil resistance, acid resistance and alkali resistance (for example, JP-A-7-278923).

SUMMARY OF THE INVENTION

However, since the whole back portion of the glove described in JP-A-11-290497 is composed of fabric, the glove has a problem that the glove is inferior in abrasion resistance and a back portion, which easily causes breakages due to rubbing or scratching, particularly fingertips and portions from the fingertips to the first joints, the second joints and the third joints (joints between fingers and backs, the same applies hereinafter) is apt to cause straggling or breakages in fibers due to rubbing or scratching. Furthermore, the gloves have a problem that the back portion of the glove is readily perforated, for example, due to sparks generated in a metal cutting work because of low strength so that they cannot play a role of protection.

Further, the glove described in Japanese Patent Publication No. 4242338 mainly aims at a slip resistant effect, and therefore in gloves shown in examples, a foam layer is provided for only a palm portion which is brought into contact with an object when gripping the object. Thus, the back portion of the glove is still composed of a base material made of fibers in these examples, and therefore, the glove is inferior in abrasion resistance, and has problems that as with the gloves in JP-A-11-290497, the back portion is apt to cause straggling or breakages, and is readily perforated or damaged, for example, due to sparks generated in a metal cutting work because of low strength and cannot play a role of protection. In addition, particularly, the moisture permeability or abrasion resistance of a foam layer of the back portion is not considered at all, and furthermore, any contrivance concerning fingertips, the first joints, the second joints and the third joints of the back portion which easily causes breakages due to rubbing or scratching of the back portion is not considered at all.

Moreover, in the glove described in JP-A-7-278923, since the surface of the glove is coated with a synthetic rubber, some of the above-mentioned problems are solved, but abrasion resistance is not necessarily sufficient. Further, since the whole area of the glove is coated with a nonpermeable coating layer of a synthetic rubber, the glove has a problem that heat is trapped in the glove, and a steamy feel is large to provide a bad feel when using it due to the lack of moisture permeability.

In view of the above state of the art, it is an object of the present invention to provide a glove which solves the above-mentioned problems of conventional techniques, has excellent moisture permeability and an excellent feel when wearing, and has excellent abrasion resistance of a back portion.

The present invention was made in order to solve the above-mentioned problems, and is characterized by the following items.

(1) A glove provided with a coating layer of rubber containing air bubbles formed at least on the surface of a back portion of a glove base material made of fibers, wherein the moisture permeability of the coating layer of the back portion ranges from 1000 to 9000 $g/m^2 \cdot 24$ hrs in terms of a measured value according to JIS L 1099 A-1 method (calcium chloride method) and the wear loss of the coating layer of the back portion is 40 mg or less in terms of a value measured after 100 revolutions by use of a tester, Nu-Martindale Abrasion and Peeling Tester, specified by EN ISO 12947-1, according to the European Standard EN 388; 2003.

(2) The glove according to (1), wherein the average air bubble content of the coating layer is 12 to 85%.

(3) The glove according to (1), wherein the wear losses of the nail portions of the coating layer and of the first joint portions, the second joint portions and the third joint portions of fingers of the coating layer are respectively 7 mg or less in terms of values measured after 100 revolutions by use of a tester, Nu-Martindale Abrasion and Peeling Tester, specified by EN ISO 12947-1, according to the European Standard EN 388; 2003.

(4) The glove according to (3), wherein the average air bubble contents of the nail portions, the first joint portions, the second joint portions and the third joint portions of the coating layer are respectively 0 to 10%.

(5) The glove according to any one of (1) to (4), wherein a face fastener is provided to a hem portion of a rubber coating layer of the glove.

(6) A method for producing a glove, which comprises the steps of;

forming a coating layer having the average air bubble content of 22 to 89% at least on the surface of a back portion of a glove base material made of fibers by use of a rubber blended solution having the average air bubble content of 7 to 88% by volume, and hot pressing the coating layer in such a way that the average air bubble content of the coating layer is 12 to 85%.

(7) The method for producing a glove according to (6), wherein a water content of the coating layer having the average air bubble content of 22 to 89% is adjusted to 20 to 170% by weight and then the coating layer is hot pressed.

(8) The method for producing a glove according to (6) or (7), wherein the coating layer is hot pressed by use of a pressing plate having a projection and depression pattern.

(9) The method for producing a glove according to (6) or (7), wherein the coating layer is hot pressed by use of a pressing plate not having a projection and depression pattern.

(10) The method of producing a glove according to any one of (6) to (9), wherein a face fastener is attached to a hem portion of a rubber coating layer.

Since the glove of the present invention is provided with a coating layer which is composed of rubber containing air bubbles and formed at least on a back portion, it has good moisture permeability and abrasion resistance of a back portion, does not bring about heat trapped and a steamy condition in glove to provide an excellent feel when wearing, hardly cause breakages due to rubbing or scratching and is hardly perforated, for example, due to sparks generated in a metal cutting work and is superior in protection performance.

DETAILED DESCRIPTION OF THE INVENTION

Figure 1:
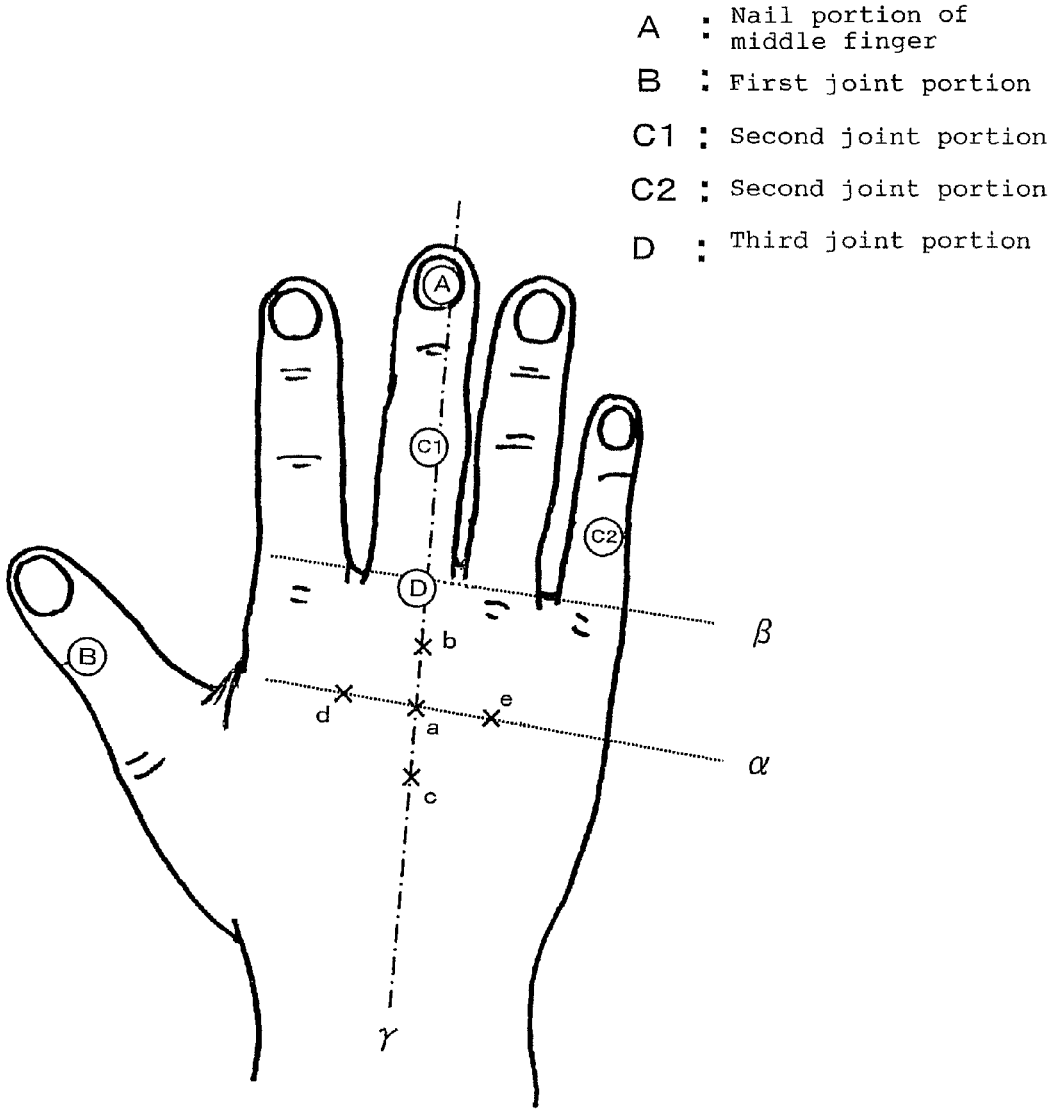
FIG. 1 is a view showing measurement points of the average air bubble content of a coating layer.

The glove of the present invention is characterized in that a coating layer of rubber containing air bubbles is formed at least on the surface of a back portion of a glove base material made of fibers, the moisture permeability of the coating layer of the back portion ranges from 1000 to 9000 g/m$^2$·24 hrs in terms of a measured value according to HS L 1099 A-1 method (calcium chloride method), and the wear loss of the coating layer of the back portion is 40 mg or less in terms of a value measured after 100 revolutions by use of a tester, Nu-Martindale Abrasion and Peeling Tester, specified by EN ISO 12947-1, according to the European Standard EN 388; 2003.

The glove of the present invention requires that the moisture permeability of the coating layer of the back portion ranges from 1000 to 9000 g/m$^2$·24 hrs in terms of a measured value according to JIS L 1099 A-1 method (calcium chloride method). When the moisture permeability is less than 1000 g/m$^2$·24 hrs, the moisture permeability of the coating layer is insufficient and heat trapped and a steamy condition in a glove are not adequately solved, and on the other hand, when the moisture permeability is more than 9000 g/m$^2$·24 hrs, the abrasion resistance of the coating layer is insufficient.

Further, the glove of the present invention requires that the wear loss of the coating layer of the back portion is 40 mg or less in terms of a value measured after 100 revolutions by use of a tester, Nu-Martindale Abrasion and Peeling Tester, specified by EN ISO 12947-1, according to the European Standard EN 388; 2003. When the wear loss is more than 40 mg. the abrasion resistance of the coating layer is insufficient and breakage of the coating layer due to rubbing or scratching cannot be adequately prevented.

In order to achieve the above-mentioned moisture permeability and abrasion resistance of the coating layer, it is preferable that the average air bubble content of the coating layer is 12 to 85%. When the average air bubble content of the coating layer is less than the above range, moisture permeability tends to be insufficient, and on the other hand, when the average air bubble content is more than the above range, abrasion resistance tends to be insufficient.

It is preferred that of the coating layer of the back portion, particularly, nail portions, the first joint portions, the second joint portions and the third joint portions of fingers, which easily cause breakages due to rubbing or scratching, have a wear loss of 7 mg or less. By keeping the wear losses of these portions below 7 mg, these portions further hardly cause breakage even though these portions are brought into contact with metal portions, etc., rubbed or scratched during works, and can further prevent a trouble that these portions are perforated due to sparks generated in metal cutting works, and therefore, gloves having even more excellent protection performance can be attained.

The average air bubble contents of the coating layers of these portions are preferably 0 to 10%.

It is preferred that the glove base material made of fibers used in the present invention is made by use of natural fibers or chemical fibers, such as cotton, wool, polyester, polyamide (nylon), acryl, aramide, reinforced polyethylene or the like; and that a stretching rate per a unit area of the glove base material made of fibers is usually about 150 to 650%. The stretching rate is the maximum enlarging rate at the time when simultaneously stretching the base material longitudinally and laterally. If the stretching rate of the glove base material made of fibers is small, wrinkles, particularly, deep wrinkles in a palm and a thumb, occur in a product prepared after the glove base material made of fibers is released from a hand mold for immersion and put on a hand mold for setting used in hot pressing, and cured (vulcanized), and further cracks often occur on a coating layer. Moreover, a knitted or sewed glove base material containing polyurethane elastic fibers in which the stretching rate is imparted to fibers is also used. The glove base material made of fibers is dyed or purified as required.

Examples of the rubber used in the present invention include natural rubber, homopolymers or copolymers such as isoprene, chloroprene, acrylic ester rubber, styrene-butadiene copolymers, acrylonitrile-butadiene copolymers, polyurethane, butyl rubber, polybutadiene rubber and silicone rubber, copolymers containing 10% by weight or less of a carboxyl-modified group, and those blended with the copolymers. The term, natural rubber includes not only natural rubber alone, but also a natural rubber-methylmethacrylate copolymer, epoxy-modified natural rubber copolymer, and the like. The term, acrylic ester rubber includes homopolymers or copolymers such as n-butyl acrylate, n-butyl methacrylate, iso-butyl acrylate, iso-butyl methacrylate, ethyl acrylate, 2-ethylhexyl acrylate, 2-ethylhexyl methacrylate, iso-propyl acrylate and iso-propyl methacrylate, which contain acrylonitrile, methyl methacrylate, allyl methacrylate, N-methylol acrylamide, acrylic acid, methacrylic acid, or the like.

Generally, a crosslinking agent, a vulcanization accelerator, an antioxidant, a thickener or the like, and a foaming agent or a foam stabilizer is added to the rubber.

Examples of the foaming agent include sodium sulfosuccinate based surfactants, alkylmonoamide disodium sulfosuccinate, potassium oleate, castor oil potassium, sodium dodecylbenzenesulfonate, and the like, and these are used singly or in combination of two or more.

Examples of the foam stabilizer include ammoniumstearate, peptide, sodium alkyldipropionate, and the like, and these are used singly or in combination of two or more. Alkyl includes lauryl, octyl, stearyl, and the like.

Further, as an air bubble stabilizer for a coating layer, if 15 to 50 parts by weight of 2,2,4-trimethyl-1,3-pentanediol-monoisobutylate is added to 100 parts by weight of rubber, processability is improved and thus preferable.

To the above rubber, known chemical foaming agents, such as toluenesulfonyl hydrazide, pp'oxybis(benzosulfonyl hydrazide), azodicarbonamide and azobisisobutylonitrile, or microcapsules may be further added to reduce the number of open holes for the purpose of preventing absorption of oils or chemicals to the surface of the coating layer. Moreover, particles of acryl, urethane, natural rubber powder, EVA powder, PVC, or NBR may be further added in order to increase a solid content to enhance abrasion resistance.

The glove of the present invention can be prepared by forming a rubber coating layer including air bubbles at least on a back portion of a glove base material made of fibers by use of a rubber blended solution including air bubbles, then hot pressing the coating layer.

A preferable production method will be described. First, a glove base material made of fibers is put on a hand mold for immersion. As the hand mold for immersion, a ceramic hand mold, an aluminum alloy hand mold or the like are suitably used, and a hand mold having a configuration, in which fingers from a thumb to a little finger are arranged linearly, is preferable. The glove base material made of fibers is put on the hand mold for immersion preheated to 50 to 70° C., and immersed in, for example, methanol containing calcium nitrate or a warm water bath of a coagulant solution, adjusted to 50 to 70° C., which contains calcium nitrate. The content of the coagulant is preferably adjusted in such a way that a rubber blended solution partially penetrates into the glove base material made of fibers in order to avoid the deterioration of touch feeling.

The immersed hand mold with the glove base material made of fibers put thereon, which has been immersed in the warm water bath of a coagulant solution, is immersed in a bath of a rubber blended solution including air bubbles. In immersion, generally, a method of immersing a glove vertically from a fingertip to a wrist is adopted.

The blended solution is mechanically foamed with a bubbling machine or a mixer. The average air bubble content of the blended solution is preferably adjusted to 7 to 88% by volume. Thereby, gloves having excellent moisture permeability and abrasion resistance, in which the desired moisture permeability of a coating layer is 1000 to 9000 g/m$^2$·24 hrs and the desired wear loss of a coating layer is 40 mg or less, are obtained.

The average air bubble content (% by volume) of the blended solution is determined by the following method.

When A ml of a blended solution without including air bubbles is stirred with a bubbling machine or a mixer to include air to obtain B ml of a blended solution including air bubbles, the average air bubble content is calculated from the following equation;

$$[(Bml-Aml)/Aml]\times 100$$

Further, the average air bubble diameter of the blended solution is preferably 10 to 200 μm, more preferably 10 to 100 μm. The average air bubble diameter of 10 to 200 μm in the blended solution increases when a coating layer is formed and hot pressed, and therefore, the average air bubble diameter of the coating layer becomes approximately 30 to 400 μm. The average air bubble diameter of the coating layer is important for design, and when the average air bubble diameter is more than 400 μm, the design tends to be impaired. Accordingly, an upper limit of the average air bubble diameter of the blended solution is preferably approximately 200 μm. On the other hand, when the average air bubble diameter of the blended solution is less than 10 μm, adjustment is difficult even if mechanical shear is exerted. The blended solution having the average air bubble diameter of 10 to 200 μm can be obtained by exerting shear on the blended solution with a high-speed mixer of about 600 to 1200 rpm or a bubbling machine.

The average air bubble diameter (μm) of the blended solution is measured by the following method.

10 g of a blended solution is put in a petri dish, and observed with a microscope VHX-900 (manufactured by KEYENCE Corp.). In images taken at 200 times magnification, ten diameters of five air bubbles selected in decreasing order of bubble diameter from the largest bubble diameter and five air bubbles selected in increasing order of bubble diameter from the smallest bubble diameter are measured in an image of 2000 μm×2000 μm, and an average of the ten diameters is calculated.

The glove immersed in the bath of a rubber blended solution including air bubbles is pull out from the blended solution, and then is dried at 60 to 95° C. by heating to be semi-cured (semi-gelled). The average air bubble content of the semi-cured coating layer is 22 to 89%. This average air bubble content can be adjusted by the concentration of solid matter of the blended solution and the viscosity of the blended solution, or a foam stabilizer. Thereafter, generally, the glove is leached by water washing and hot pressed. By hot pressing, a part of the air bubbles in the coating layer is crushed and the air bubbles are communicated with one another to increase the moisture permeability, and walls forming air bubbles are melted to one another to decrease the air bubble content to increase the abrasion resistance. The coating layer can be beautifully hot pressed by adjusting the water content of the coating layer before hot pressing to 20 to 170% by weight, and particularly, when the coating layer is provided with a projection and depression pattern through hot pressing, the projection and depression pattern can be beautifully formed.

The water content (% by weight) in the coating layer before hot pressing is calculated from the following equation.

[(weight (B) of a glove after leaching−weight (A) of a glove before leaching)/weight (A) of a glove before leaching]×100

Hot pressing is carried out under the conditions of a pressing temperature of 60 to 300° C. and a pressing time of 1 to 180 seconds with a pressing pressure of 1 to 100 kgf/cm$^2$ applied to the glove put on a hand mold for immersion and provided with a coating layer from a back side or both of a back side and a palm side of the glove with a pressing plate. In this case, a projection and depression pattern can be formed on a back side of the glove or on both of a back side and a palm side, as required.

When the projection and depression pattern is formed, a pressing plate having a projection and depression pattern (hereinafter, referred to as a projection and depression plate) is used.

When the projection and depression pattern is formed on only the back side, the projection and depression plate is used for the pressing plate on the back side and a pressing plate without having a projection and depression pattern (hereinafter, referred to as a projection plate) is used for the pressing plate on the palm side. Further, when the projection and depression pattern is used on both of the back side and the palm side, the projection and depression plate is used for both of the back side and the palm side.

As another method, the glove in which a coating layer is formed is removed from the hand mold for immersion, put on a flat mold again, and hot pressed as with the above method. Further, when hot pressing is carried out from both of the back side and the palm side of the glove, pressing can be performed at a uniform pressure by using a female mold composed of a projection and depression plate or a projection plate prepared in conformity with the configuration of the hand mold for immersion. In this case, hot pressing can be applied up to a side of the glove, and when the female mold composed of a projection and depression plate is used, a projection and depression pattern is beautifully formed up to a side of the glove.

The depth of projection and depression (difference in level between the projection and the depression) of the projection and depression plate is preferably in a range from about 0.1 mm to about 1.2 mm, and more preferably about 0.3 mm to about 1.0 mm from the viewpoint of a grip force and design. The depth of the projection plate without having a projection and depression pattern is the same as above. By adjusting the depth of projection and depression of the projection and depression plate or the depth of the projection plate within the above range, abrasion resistance and moisture permeability can be adjusted to a desired range. A shape of the projection and depression pattern of the projection and depression plate is not particularly limited, and examples of the shape include a variety of geometric patterns such as a circle, a shape of an ellipse, a rectangle, a polygonal shape, and the like, and indefinite patterns (See FIG. 2), and when these are arranged regularly or irregularly, not only abrasion resistance is improved, but also a grip force is improved and design is enhanced.

The coating layer is hot pressed so that its average air bubble content is 12 to 85%. When the average air bubble content is less than 12%, moisture permeability is insufficient, and when the average air bubble content is more than 85%, abrasion resistance is insufficient, and therefore it becomes difficult to obtain a coating layer in which the desired moisture permeability is 1000 to 9000 $g/m^2 \cdot 24$ hrs and the desired wear loss is 40 mg or less.

For decreasing the average air bubble content of the coating layer, methods in which the depth of the projection and depression plate or the projection plate is increased, and an area of a projection portion is increased, and when the projection and depression plate is used, methods in which a time of hot pressing is increased, or hot pressing is repeated twice or more are employed, and for increasing the average air bubble content of the coating layer, methods contrary to the above methods are employed.

The average air bubble content (%) of the coating layer before or after pressing is determined by the following method.

As shown in FIG. 1, a point of intersection of a line α, which extends from a finger crotch between a thumb and an index finger and is parallel to a line β connecting a finger crotch between an index finger and a middle finger to a finger crotch between a third finger and a little finger, and a line γ connecting a middle finger tip and a center of a wrist is taken as a point a, and a point 1 cm upward and a point 1 cm downward from the point a on the line γ are taken as b and c, respectively, and a point 1 cm leftward and a point 1 cm rightward from the point a on the line α are taken as d and e, respectively. Images of cross-sections of the coating layers, indicated by lines b-c and d-e, which are taken at 200 times magnification by a microscope VHX-900 (manufactured by KEYENCE Corp.), are obtained, and an average ratio of areas of air bubbles in a division of 300 μm×300 μm of the images is calculated from the following equation.

$$[\text{Total air bubble area } (\mu m^2)/90000\ \mu m^2] \times 100$$

Particularly, the nail portions, and the first joint portions, the second joint portions and the third joint portions of fingers, which easily cause the wear or the abrasion of the back portion, are preferably pressed as required in such a way that the average air bubble content of the coating layer is 0 to 10%. Thereby, a glove, in which a wear loss is 7 mg or less and abrasion resistance is locally improved, is obtained. The glove, in which abrasion resistance is improved as described above, further hardly causes breakage due to rubbing or scratching during a work, and further hardly causes a trouble that the back portions of the glove is perforated even in a work where sparks fly about such as in a metal cutting work, and therefore, a glove having extremely excellent protection performance can be provided. In addition, when the average air bubble content of the coating layer is 0 to 10% locally, the moisture permeability is reduced to about 100 to 500 $g/m^2 \cdot 24$ hrs at such portions, but since the moisture permeability of other portions is 1000 to 9000 $g/m^2 \cdot 24$ hrs, the moisture permeability of the whole back portion is sufficient and this does not bring about a problem practically.

In order to keep the average air bubble contents of the nail portions of the coating layer, and the first joint portions, the second joint portions and the third joint portions of fingers of the coating layer in a range of 0 to 10%, a method, in which a depth of a projection and depression plate or a projection plate for these portions is made to be larger than that of other portions or areas of projections for the projection and depression plate are increased, is preferable because hot pressing only have to be carried out once. However, by carrying out the hot pressing twice or more, the average air bubble contents of these portions can also be adjusted.

The average air bubble contents of the nail portions of the coating layer, and the first joint portions, the second joint portions and the third joint portions of fingers of the coating layer are calculated by the following method.

As shown in FIG. 1, images of cross-sections of the coating layers of a nail portion A of a middle finger, a first joint B of a thumb, a second joint C1 of a middle finger, a second joint C2 of a little finger and a third joint D of a middle finger, which are taken at 200 times magnification by a microscope VI-DC-900 (manufactured by KEYENCE Corp.), are obtained, and an average ratio (%) of areas of air bubbles in a division of 300 μm×300 μM of the images is calculated from the following equation.

$$[\text{Total air bubble area } (\mu m^2)/90000\ \mu m^2] \times 100$$

In addition, since the nail portions and the joint portions vary with a glove size and a hand size of wearer, it is preferred that the gloves are previously adjusted according to a small size (S), a middle size (M), a large size (L) or an oversize (LL), or a little broader area is hot pressed so that the coating layer can be applied regardless of whether a size is large or small.

The glove is released from the hand mold, and then put on a hand mold for setting having a configuration close to a human hand, in which a thumb is located on an inner side, cured at 120 to 130° C. for 40 to 60 minutes and released from the hand mold.

A hem portion (wrist portion) of the released glove is cut as required for preventing slippage, for example, and a part such as a face fastener (hook-and-loop fastener) is sewed to be finished.

Hereinafter, the present invention will be described in more detail by way of examples and comparative examples, but the present invention is not limited to these examples and comparative examples.

In addition, the average air bubble content of a blended solution, the water content of a coating layer, the average air bubble content of the coating layer, and the moisture permeability and the wear loss of the coating layer were measured by the methods described above.

Figure 3:
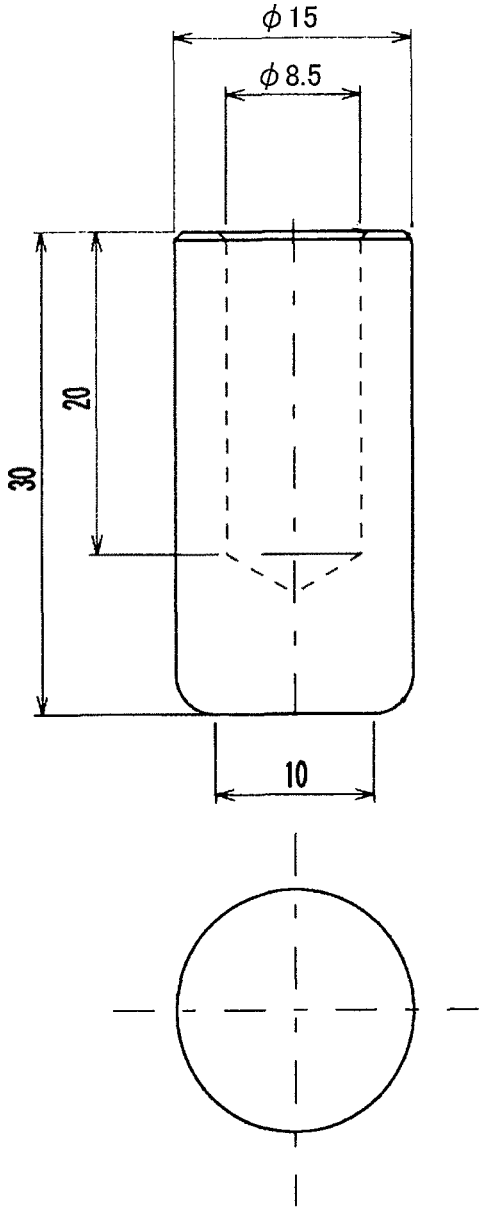
FIG. 3 is a schematic view showing a jig for fastening a test piece in measuring a wear loss by use of a tester, Nu-Martindale.

The wear loss was measured by a method of using a tester, Nu-Martindale, described above, and in the present invention, a jig shown in FIG. 3 was used as a jig for fastening a test piece in order to measure the wear losses of nail portions or local portions in joint portions. A unit of figures in FIG. 3 is a millimeter.

Further, the steamy feel was evaluated based on the presence or absence of a steamy feel in wearing the gloves actually. The perforation was evaluated by placing the glove so as to be hit by sparks generated in cutting an equal-angle steel and observing the surface of a coating layer of the glove with the naked eye after cutting the steel.

| Blended solution: | |
|---|---|
| NBR latex (manufactured by ZEON Corp., Lx550) | 100 parts by weight |
| Colloidal sulfur (manufactured by Hosoi Chemical Industry Co., Ltd.) | 2.0 parts by weight |
| Zinc oxide (No. 2 Chinese white, manufactured by Seido Chemical Industry Co., Ltd) | 1.0 part by weight |
| Vulcanization accelerator (zinc dibutyldithiocarbamate, manufactured by OUCHI SHINKO CHEMICAL INDUSTRIAL Co., Ltd.) | 0.5 parts by weight |
| Antioxidant (2,2'-methylenebis(4-ethyl-6-tert-butylphenol)) (manufactured by Bayer Holding Ltd., BKF) | 0.5 parts by weight |
| Pigment (manufactured by MIKUNI COLOR Ltd., SABlue 12402) | 0.3 parts by weight |
| Thickener (polyacrylic ester) (manufactured by TOAGOSEI Co., Ltd., A-7075) | 0.2 parts by weight |
| Foaming agent (sodium sulfosuccinate) (manufactured by Kao Corp., PELEX TA) | 3.0 parts by weight |
| Foam stabilizer (sodium lauryldipropionate) (manufactured by Takemoto Oil & Fat Co., Ltd., PIONIN C-158-D) | 3.0 parts by weight |
| Water (adjusted in such a way that solid content is 38% by weight) | |

EXAMPLE 1

The above-mentioned rubber blended solution was stirred so as to include air by an automatic handheld mixer for home use to prepare a blended solution in which an average air bubble content is 33% by volume (average air bubble diameter 30 μm).

A knitted glove (280 d) made of wooly nylon was put on a hand mold for immersion, in which fingers from a thumb to a little finger are arranged linearly, and immersed in a 0.7 weight % methanol coagulating solution of calcium nitrate, and then the glove was immersed vertically in the blended solution including air bubbles from a fingertip to a wrist, and thereafter, the glove was dried at 75° C. for 10 minutes to be semi-cured (semi-gelled) and released from the hand mold. The average thickness of the coating layer was 0.7 mm. The released glove was leached by water washing, and the water content of the coating layer was adjusted to 50% by weight, and then the glove was put on the flat mold again and hot pressed.

Figure 2:
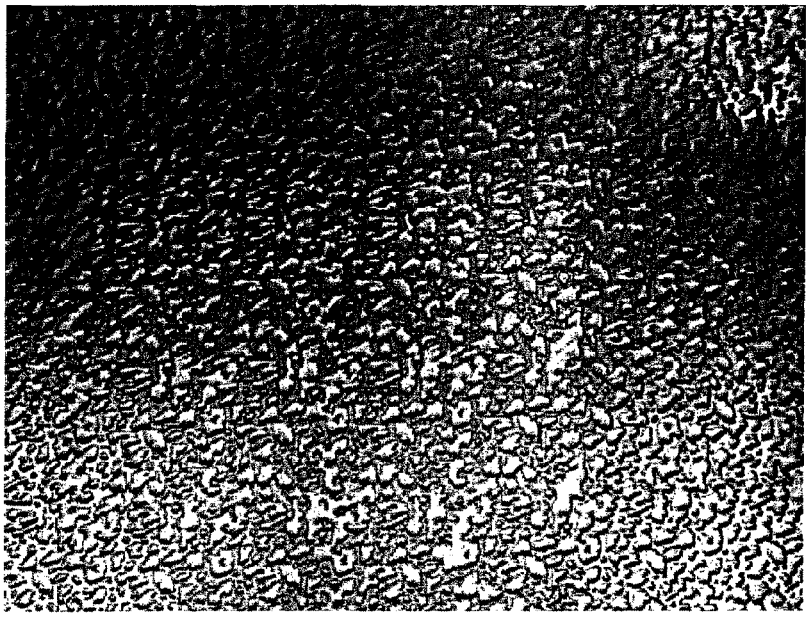
FIG. 2(*a*) is a photograph showing a pressing plate used in Examples, which has an indefinite projection and depression pattern, and FIG. 2(*b*) is a magnified photograph (200 times magnification) of the pressing plate.
Figure 2:
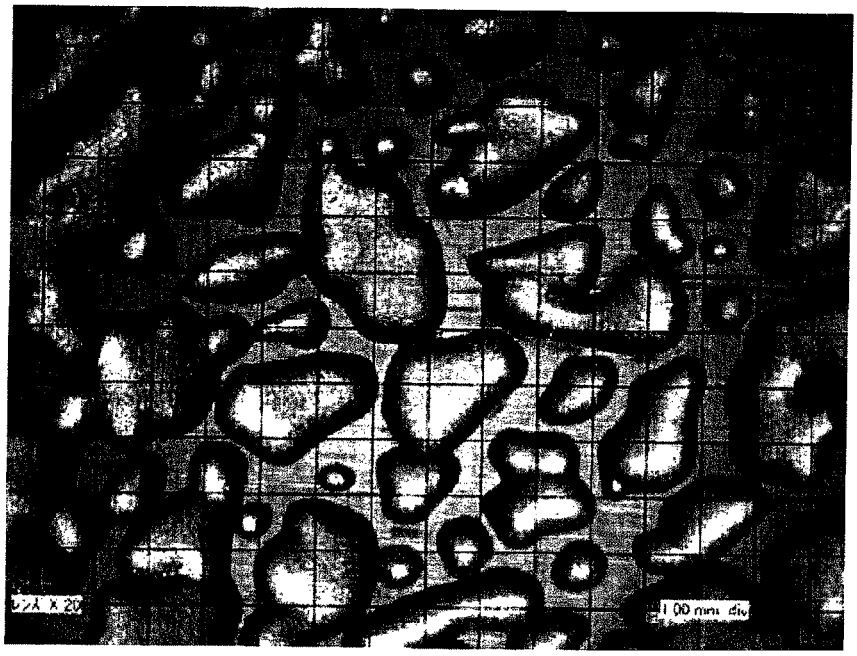

As a hot pressing plate, a projection and depression plate having an indefinite projection and depression pattern (depth is 0.7 mm and a ratio of a projection area to a depression area per 1 $cm^2$ is 8/3) shown in FIGS. 2(*a*) and 2(*b*) (cross-cut in FIG. 2(*b*) represents a dimension and one side of a cross-cut indicates 1 mm) on a back side and a palm side of the glove was used, and the glove was hot pressed at a pressure of 1 $kgf/cm^2$ at 180° C. for 5 seconds.

The hot pressed glove was put on a hand mold for setting (a hand mold close to a human hand, in which a thumb is located at a position shifted to a palm side) again, cured at 120° C. for 60 minutes and released from the hand mold to obtain a glove in which a coating layer including air bubbles was formed on both sides of a palm portion and a back portion.

A summary of production conditions and the results of evaluation of properties are shown in Table 1.

EXAMPLE 2

A glove, in which a coating layer including air bubbles was formed on both sides of a palm portion and a back portion, was prepared in the same manner as in Example 1 except for changing the average air bubble content of the blended solution from 33% by volume to 88% by volume.

A summary of production conditions and the results of evaluation of properties are shown in Table 1.

EXAMPLE 3

A glove was prepared in the same manner as in Example 1 except for changing the hot pressing plate from the projection and depression plate having a projection and depression pattern to a projection plate (depth is 0.7 mm) without having a projection and depression pattern.

A summary of production conditions and the results of evaluation of properties are shown in Table 1.

EXAMPLE 4

A glove was prepared in the same manner as in Example 2 except for changing the hot pressing plate from the projection and depression plate having a projection and depression pattern to a projection plate (depth is 0.7 mm) without having a projection and depression pattern.

A summary of production conditions and the results of evaluation of properties are shown in Table 1.

COMPARATIVE EXAMPLE 1

A glove was dried, leached, hot pressed with a projection and depression plate, and cured in the same manner as in Example 1 except that only the palm portion of the knitted glove made of wooly nylon was immersed in the blended solution to prepare a glove in which a coating layer including air bubbles was formed on only a palm portion.

A summary of production conditions and the results of evaluation of properties are shown in Table 1.

COMPARATIVE EXAMPLE 2

A glove, in which a coating layer including air bubbles is formed on both sides of a palm portion and a back portion, was prepared in the same manner as in Example 1 except for changing the average air bubble content of the blended solution from 33% by volume to 3.5% by volume.

A summary of production conditions and the results of evaluation of properties are shown in Table 1.

COMPARATIVE EXAMPLE 3

A glove, in which a coating layer including air bubbles was formed on both sides of a palm portion and a back portion, was prepared in the same manner as in Example 1 except for changing the average air bubble content of the blended solution from 33% by volume to 103% by volume.

A summary of production conditions and the results of evaluation of properties are shown in Table 1.

COMPARATIVE EXAMPLE 4

A glove, in which a coating layer including air bubbles was formed on both sides of a palm portion and a back portion, was prepared in the same manner as in Example 1 except for changing the average air bubble content of the blended solution from 33% by volume to 3.5% by volume and changing the hot pressing plate from the indefinite projection and depression plate to a projection plate.

A summary of production conditions and the results of evaluation of properties are shown in Table 1.

COMPARATIVE EXAMPLE 5

A glove, in which a coating layer including air bubbles was formed on both sides of a palm portion and a back portion, was prepared in the same manner as in Example 1 except for changing the average air bubble content of the blended solution from 33% by volume to 103% by volume and changing the hot pressing plate from the indefinite projection and depression plate to a projection plate.

A summary of production conditions and the results of evaluation of properties are shown in Table 1.

EXAMPLE 5

The glove obtained in Example 1, in which a coating layer including air bubbles was formed on both sides of a palm portion and a back portion, was put on a flat mold, and nail portions, and the first joint portions, the second joint portions and the third joint portions of the coating layer of a back portion were locally hot pressed again with a projection plate (depth is 0.7 mm).

A summary of production conditions and the results of evaluation of properties are shown in Table 2.

EXAMPLE 6

The glove obtained in Example 2, in which a coating layer including air bubbles was formed on both sides of a palm portion and a back portion, was put on a flat pattern, and nail portions, and the first joint portions, the second joint portions and the third joint portions of the coating layer of a back portion were locally hot pressed again with a projection plate (depth is 0.7 mm).

A summary of production conditions and the results of evaluation of properties are shown in Table 2.

It is apparent from the results shown in Table 1 that the gloves of the present invention represented by the gloves in Examples 1 to 4 have no steamy feel because of excellent moisture permeability of a back portion, and are not perforated due to sparks generated in a metal cutting work because of excellent abrasion resistance and is superior in protection performance.

Further, it is apparent from the results shown in Table 2 that by locally hot pressing nail portions, and the first joint portions, the second joint portions and the third joint portions of a back portion of the gloves of the present invention, the abrasion resistance of these portions is further enhanced, and gloves having a further excellent protection performance are obtained even under further severe working conditions.

TABLE 1

| | Rubber blended solution | | | Air bubble content of coating layer of back portion | | Properties of back portion | | | |
|---|---|---|---|---|---|---|---|---|---|
| | Kind | Air bubble content (%) | Back side of hot pressing plate | Before hot pressing | After hot pressing | Moisture permeability $g/m^2 \cdot 24hrs$ | Steamy feel | Wear loss (mg) | Perforation |
| Example 1 | NBR | 33 | Indefinite projection and depression plate | 35 | 18 | 1094 | Absence | 6.5 | Absence |
| Example 2 | NBR | 88 | Indefinite projection and depression plate | 89 | 76 | 8090 | Absence | 22 | Absence |
| Example 3 | NBR | 33 | Projection plate | 35 | 19 | 2141 | Absence | 8.5 | Absence |
| Example 4 | NBR | 88 | Projection plate | 89 | 50 | 7452 | Absence | 17.7 | Absence |
| Comp. Example 1 | NBR | 33 | — | — | — | 13449 | Absence | Broken | Presence |
| Comp. Example 2 | NBR | 3.5 | Indefinite projection and depression plate | 15 | 11 | 570 | Presence | 5.9 | Absence |
| Comp. Example 3 | NBR | 103 | Indefinite projection and depression plate | 99 | 94 | 9600 | Absence | 42.6 | Absence |
| Comp. Example 4 | NBR | 3.5 | Projection plate | 14 | 10 | 566 | Presence | 5.4 | Absence |
| Comp. Example 5 | NBR | 103 | Projection plate | 98 | 93 | 9570 | Absence | 41.7 | Absence |

TABLE 2

| | Back side of hot pressing plate | | Air bubble content of coating layer of back portion after hot pressing | | Properties of nail portion and joint portions | | |
|---|---|---|---|---|---|---|---|
| | Portions other than nail portion and joint portions | Nail portion, joint portions | Portions other than nail portion and joint portions | Nail portion, joint portions | Steamy feel | Wear loss (mg) | Perforation |
| Example 5 | Indefinite projection and depression plate | Projection plate | 18 | 5 | Absence | 2.1 | Absence |
| Example 6 | Indefinite projection and depression plate | Projection plate | 76 | 8 | Absence | 4.9 | Absence |

EXAMPLE 7

Figure 4:
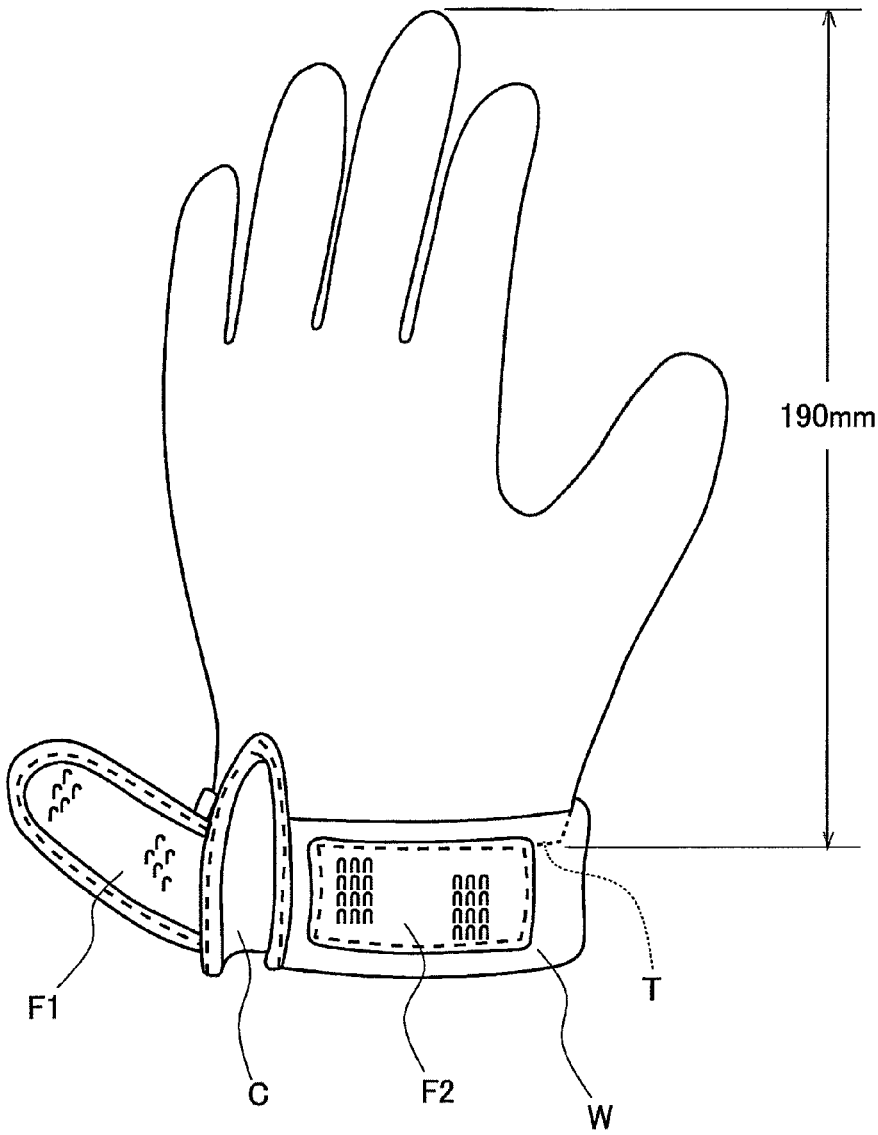
FIG. 4 is a schematic view showing a glove on the hem of which a face fastener is sewed.

A hem of the glove obtained in Example 1 was laterally cut at a position about 190 cm from a tip of a middle finger (position indicated by T in FIG. 4).

Next, on the cut hem portion, a knitted rubber (40 mm in width) W was sewed with threads (manufactured by FUJIX Ltd., polyester spun thread No. 60 yarn number count) using a zigzag stitch sewing machine (manufactured by Brother Industries, Ltd., model LZ2-B856E-301).

Next, a slit C of about 40 mm in length was vertically cut in a side on a little finger side. Then, a face fastener (hook-like male: 30×60 mm, loop(pile)-like female: 30×50 mm) was prepared. The male portion F1 of the face fastener was bordered with a bias tape (15 mm×120 mm) in advance. In bordering, the bias tape was sewed by a sewing machine (MITSUBISHI LY2-3300 manufactured by Mitsubishi Electric Corp.) using threads (manufactured by COATS PLC, 45 tex, Nylon Thread Yarn Wine 916PQ). This bordered male portion F1 of the face fastener was sewed on a side closer to a little finger of the above slit C by straight stitch, and the female portion F2 of the face fastener was sewed similarly on a portion of the knitted rubber W corresponding to the male portion F1 of the face fastener. Finally, the edge of the slit C was bordered with a bias tape to obtain a glove preventing slippage.

Since the rubber coating layer is formed on the glove made of fibers (knitted gloves), there is no straggling of the glove made of fibers in cutting the glove, and therefore the step of preventing straggling is unnecessary and workability is extremely good.

In addition, it is needless to say that there is no problem if the male portion F1 and the female portion F2 of the face fastener change places in the present example.

In accordance with the present invention, since a coating layer composed of rubber containing air bubbles is formed at least on a back portion of a glove, it is possible to provide a glove which has good moisture permeability and abrasion resistance of the back portion, does not cause heat trapped and a steamy condition in glove to provide an excellent feel when wearing, can protect the back portion from breakages due to rubbing or scratching and protect from perforations or damages due to sparks generated in a metal cutting work and is superior in protection performance.

What is claimed is:

1. A glove provided with a coating layer of rubber containing air bubbles formed at least on the surface of a back portion of a glove base material made of fibers, wherein the moisture permeability of the coating layer of the back portion ranges from 1000 to 9000 g/m$^2$·24 hrs in terms of a measured value according to JIS L 1099 A-1 method (calcium chloride method) and the wear loss of the coating layer of the back portion is 40 mg or less in terms of a value measured after 100 revolutions by use of a tester, Nu-Martindale Abrasion and Peeling Tester, specified by EN ISO 12947-1, according to the European Standard EN 388; 2003.

2. The glove according to claim 1, wherein the average air bubble content of the coating layer is 12 to 85%.

3. The glove according to claim 1, wherein the wear losses of nail portions, first joint portions, the second joint portions and the third joint portions of the coating layer are respectively 7 mg or less in terms of values measured after 100 revolutions by use of a tester, Nu-Martindale Abrasion and Peeling Tester, specified by EN ISO 12947-1, according to the European Standard EN 388; 2003.

4. The glove according to claim 3, wherein the average air bubble contents of the nail portions, the first joint portions, the second joint portions and the third joint portions of the coating layers are respectively 0 to 10%.

5. The glove according to any one of claims 1 to 4, wherein a face fastener is provided to a hem portion of a rubber coating layer of the glove.

6. A method for producing a glove, which comprises the steps of;

forming a coating layer having the average air bubble content of 22 to 89% at least on the surface of a back portion of a glove base material made of fibers by use of a rubber blended solution having the average air bubble content of 7 to 88% by volume, and hot pressing the coating layer in such a way that the average air bubble content of the coating layer is 12 to 85%.

7. The method for producing a glove according to claim 6, wherein a water content of the coating layer having the average air bubble content of 22 to 89% is adjusted to 20 to 170% by weight and then the coating layer is hot pressed.

8. The method for producing a glove according to claim 6 or 7, wherein the coating layer is hot pressed by use of a pressing plate having a projection and depression pattern.

9. The method for producing a glove according to claim 6 or 7, wherein the coating layer is hot pressed by use of a pressing plate not having a projection and depression pattern.

10. The method for producing a glove according to claim 6 or 7, wherein a face fastener is attached to a hem portion of a rubber coating layer of the glove.

* * * * *